US005392834A

United States Patent [19]

Borgardt

[11] Patent Number: 5,392,834

[45] Date of Patent: Feb. 28, 1995

[54] BREAKAWAY BI-FOLDING DOOR ASSEMBLY

[76] Inventor: Ronald Borgardt, 2316 Tifton St., Kenner, La. 70062

[21] Appl. No.: 66,786

[22] Filed: May 24, 1993

[51] Int. Cl.[6] ..... E06B 3/48

[52] U.S. Cl. ..... 160/118; 160/206

[58] Field of Search ..... 160/118, 119, 185, 186, 160/194, 195, 206, 199, 210, 213, 335

[56] References Cited

U.S. PATENT DOCUMENTS

| | | | |
|---|---|---|---|
| 1,051,054 | 1/1913 | Anderson . | |
| 1,514,140 | 11/1924 | Dodge . | |
| 1,893,147 | 1/1933 | Oberdorfer et al. . | |
| 2,307,560 | 1/1943 | Apel | 16/148 |
| 3,029,868 | 4/1962 | Ogburn et al. | 160/113 |
| 3,136,538 | 6/1964 | Dimmitt et al. | 268/39 |
| 3,144,077 | 8/1964 | Dickinson et al. | 160/206 |
| 3,318,047 | 5/1967 | Carson | 49/149 |
| 3,342,246 | 9/1967 | Reiss | 160/195 |
| 3,372,689 | 3/1968 | Goudy | 160/206 X |
| 3,466,805 | 9/1969 | Muessel | 49/141 |
| 4,070,795 | 1/1978 | Lussier | 49/141 |
| 4,078,333 | 3/1978 | Lussier | 49/141 |
| 4,305,227 | 12/1981 | Georgelin | 49/141 |
| 4,534,395 | 8/1985 | Carroll | 160/118 X |
| 4,562,665 | 1/1986 | Blackston | 49/44 |
| 5,042,555 | 8/1991 | Owens | 160/199 |
| 5,242,005 | 9/1993 | Borgardt | 160/118 |

*Primary Examiner*—David M. Purol
*Attorney, Agent, or Firm*—Brumbaugh, Graves, Donohue & Raymond

[57] ABSTRACT

A breakaway bi-folding door assembly, which would include at least a pair of bi-folding doors of the type wherein a first end of one door panel is hinged to a door frame, and a second end of a second door panel travels within a slot in the frame to allow the door panel to fold and unfold between open and closed positions for defining an open or closed doorway through a passage. Further there is provided a pivoting frame member positioned above the second door panel, and hinged to the second door at a first end and attached to the second door at a second end, so that at any point along its travel, the attaching means could be overcome by force and the second end of the second door panel can swing freely of the pivoting frame member. Upon the pivoting frame member sliding within the slot, the second door would return to its attached position automatically to form the bi-folding door configuration.

8 Claims, 8 Drawing Sheets

BREAKAWAY BI-FOLDING DOOR ASSEMBLY

BACKGROUND OF THE INVENTION

1. Field Of The Invention

The apparatus of the present invention relates to bi-folding doors. More particularly, the present invention relates to a novel assembly of a bi-folding door which allows the bi-folding doors to be broken away from the frame, swing open in the manner of a conventional door during emergency situations, and return automatically to the bi-folding door configuration.

2. General Background

In general, bi-folding doors are very useful in many areas where there is insufficient space to allow a conventional door to be swung open on a normal basis. Therefore, when a bi-folding door is utilized because of the nature of the construction, the doors when open would provide in effect, one-half of the space against the adjacent wall that would be normally occupied by a conventional door. For examples, in hospitals where bi-folding doors are very useful, were one to use a conventional door at all times in a passageway, in the construction one would have to maintain sufficient space on the adjacent wall so as to allow the conventional doors to swing open. Such an inconvenience might not provide for the fact that one could place a doorway into a room at that position in view of the fact that a conventional door would swing open into the doorway. In order to avoid this situation, bi-folding doors are commonly utilized.

However, one of the shortcomings of bi-folding doors is the fact that during emergency situations, many, if not all, state fire codes require that doors have the ability to be swung open, as with a conventional door, simply upon manual force from a person in the hallway. This is often the case when patients must be rushed out of a hallway and one cannot wait for either the electric eye of the bi-folding door or one would have insufficient space to move through the passageway, since the bi-folding door, when folded, does occupy some space in the passageway.

Applicant does have an application currently on file which provides for a bi-folding door assembly, which includes at least a pair of bi-folding doors of the type having a first end hinged to an upper frame, and a second end travelling within a slot in the frame to allow the doors to fold and unfold between open and closed positions for defining an open or closed doorway through a passage. Furthermore, the assembly would include a movable plate member for each of the bi-folding doors, positioned on the frame, and hinged along one end for moving outward from the frame. The current application addresses the change from a bi-folding door configuration to a free-swinging door configuration in a very different, and more simplified manner, including the ability of the door to return automatically to the bi-folding door configuration without having to reset any components or the like.

There have been several patents granted in the art which address bi-folding or sliding doors, the most pertinent being as follows:

| PATENT NO. | INVENTOR: | TITLE: |
|---|---|---|
| 2,311,470 | Ritter | "Flexible Panel, Door, Or Closure" |
| 4,387,760 | Greschbach | "Sliding Folding Door" |

-continued

| PATENT NO. | INVENTOR: | TITLE: |
|---|---|---|
| 3,949,801 | Sasaki | "Device For Automatically Closing A Folding Door" |
| 3,385,344 | Andrews | "Bi-Fold Door Structure" |
| 3,359,594 | Pastoor | "Folding Closures" |
| 3,297,077 | Garbus | "Folding Door Structure" |
| 3,233,277 | Hirashiki | "Hinge" |
| 3,229,751 | Moorer | "Folding Door Structure" |
| 2,952,313 | Stroup | "Sectional Upwardly Acting Doors And Like Closures" |
| 2,331,512 | Siedschlag | "Hinge" |

Other objects of the invention will be obvious to those skilled in the art from the following description of the invention.

SUMMARY OF THE PRESENT INVENTION

The apparatus of the present invention solves the shortcomings in the art in a simple and straightforward manner. What is provided is a breakaway bi-folding door assembly, which includes at least a pair of hinged bi-folding door panels of the type wherein a first edge of one door panel is hinged to a frame, and a first second edge of a second door panel travels within a slot in the frame to allow the doors to fold and unfold between open and closed positions for defining an open or closed doorway through a passage. Further there is provided a pivoting frame member positioned at the top of the second door panel, and which is hinged to the second door panel at one end and latched to the second door panel at a second end, so that at any point along its travel, the latching means can be overcome, and the end of the second door panel would swing freely of the plate member. Upon the pivoting frame member sliding within the slot to the closed position, the second door panel is returned to its latched position automatically to form the bi-folding door configuration.

Therefore, it is a principal object of the present invention to provide a bi-folding door assembly which has the feature to break away to a fully opened position, through one of the bi-folding door panels unlatching from a pivoting frame member above the door panel;

It is a further principal object of the present invention to provide a bi-folding door assembly, which may be used as standard bi-folding door assembly yet in an emergency can be swung to the fully open position when necessary;

It is still a further object of the present invention to provide a break away bi-folding door assembly, which, upon application of force by a person moving therethrough, unlatches one end of one of the bi-folding door panels, so that the door panel swings freely and forms a full opening as with a conventional door; and It is still a further object of the present invention to provide a bi-folding door assembly which allows one door panel to be released from the bi-folding door configuration into a free swinging configuration, and return wherein the released door panel returns to the bi-folding door configuration automatically.

DETAILED DESCRIPTION OF THE PREFERRED EMBODIMENT

Figure 1A:
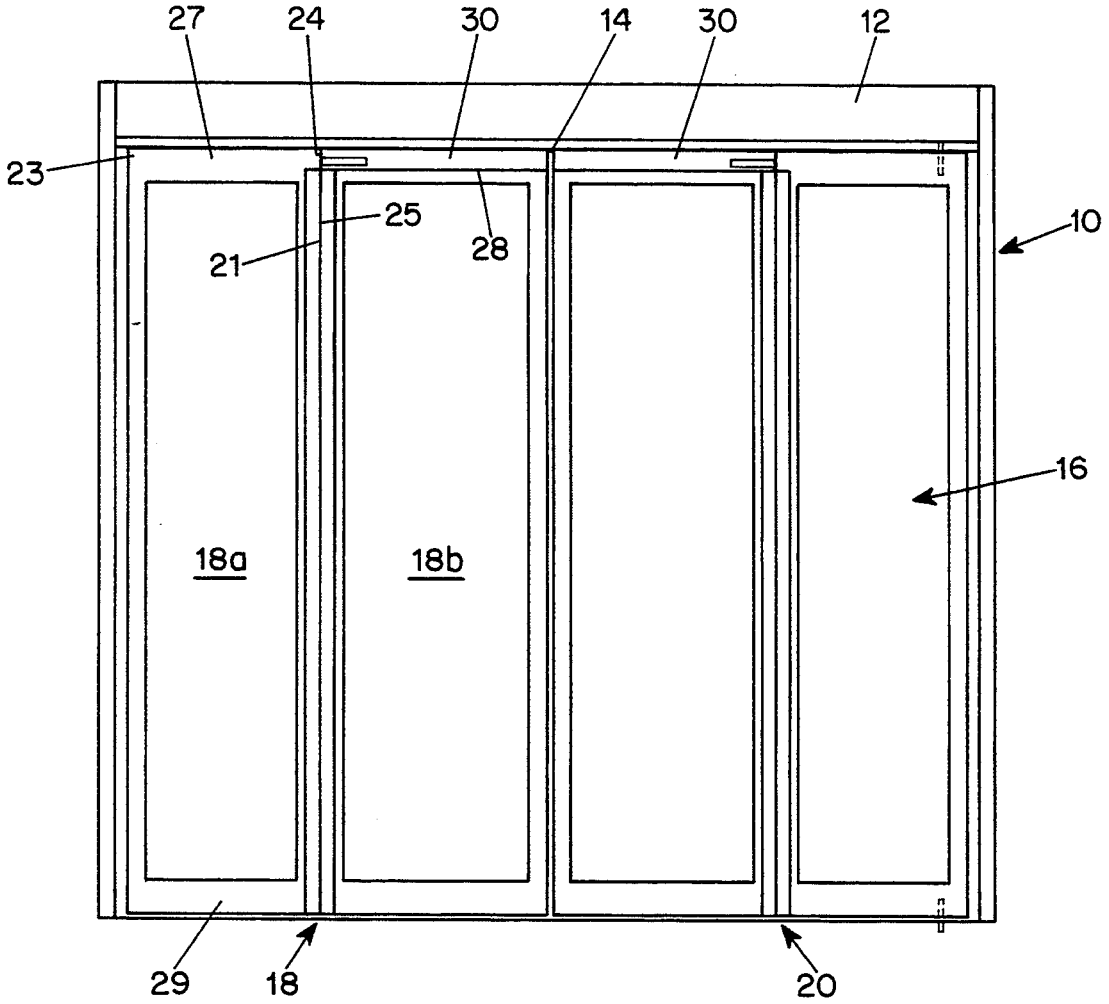
FIGS. 1A and 1B illustrate front and top views of the break away bi-folding door assembly in the preferred embodiment of the present invention in the fully closed position.
Figure 1B:
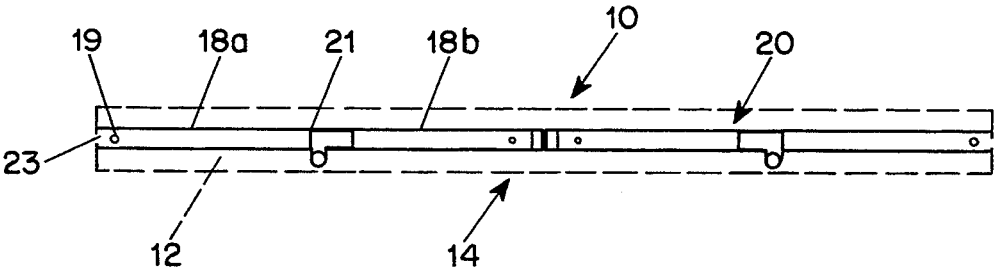

For a further understanding of the nature and objects of the present invention, reference should be had to the following detailed description taken in conjunction with the accompanying drawings, in which like parts are given like reference numerals, and wherein:

FIGS. 1 through 7B illustrate the preferred embodiment of the apparatus of the present invention by the numeral 10. As illustrated, the breakaway bi-folding door apparatus 10 would generally comprise an upper frame means 12 extending across the opening of a doorway 14 as illustrated in FIG. 1A, of the type generally that would provide a wide doorway passage such as found in hospital corridors or the like. The apparatus 10 would further comprise a plurality of door panels, in two pairs 18 and 20. For purposes of discussion, pair 18 only will be discussed, since pair 20 would operate identically to pair 18, so that together they form the entire bi-folding door assembly 10 across doorway 14.

The first pair 18 would include a pair of door panels **18*a* and 18*b* hingedly connected to one another along common longitudinal edges 21** so as to provide a continuous hinged connection therebetween.

Figure 2A:
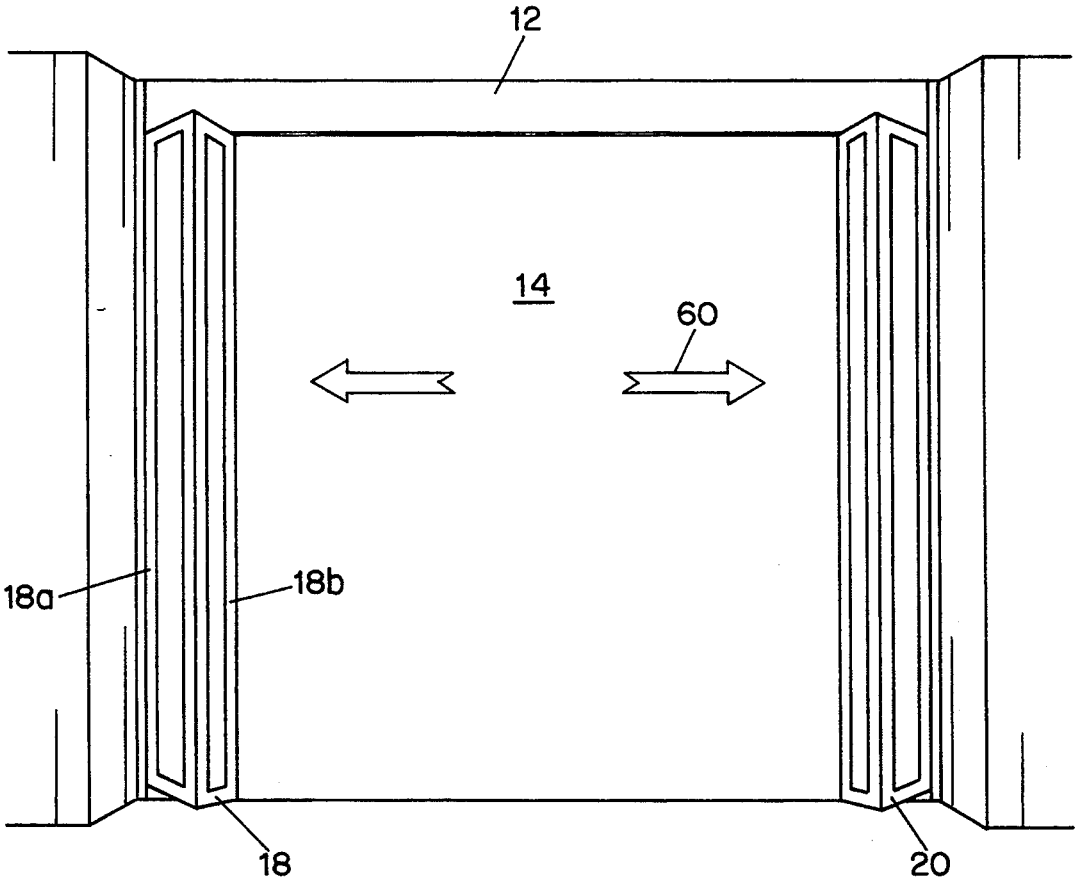
FIGS. 2A and 2B illustrate front and top views of the break away bi-folding door assembly in the preferred embodiment of the present invention in the fully open position.
Figure 2B:
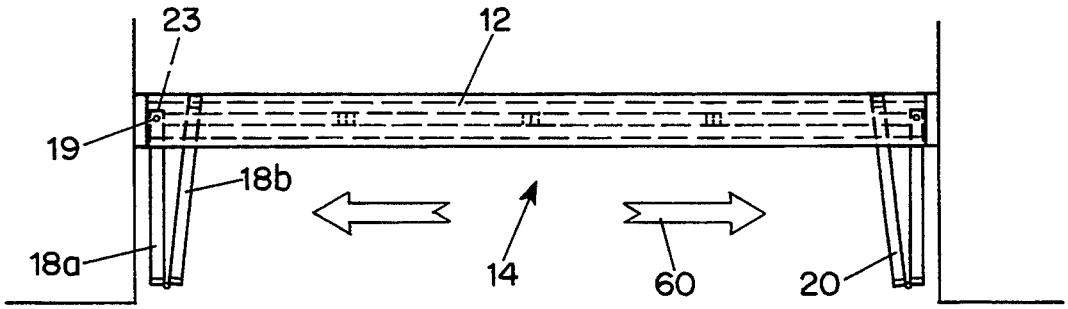

The connection of the door panels **18*a* and 18*b* to the upper frame 12 is critical to the operation of the system. As illustrated the first door panel 18*a* is hingedly connected to the frame 12 via hinge 19 at its first hinged edge 23, and is therefore fixed in its position to the frame 12, for rotation only about hinge 19. The second edge 24 of panel 18*a* is hingedly connected to a first edge 25 of door panel 18*b* which defines the common edge 21 as described earlier. However, this common edge 21 between panels 18*a* and 18*b* is not connected to frame 12, so that, as in all bi-folding doors, hinged edge 21 between door panels 18*a* and 18*b* is able to move away from frame 12 when the bi-folding doors are open, for example by motor-driven rotation about hinge 19, as illustrated in FIGS. 2A and 2B**.

Figure 5:
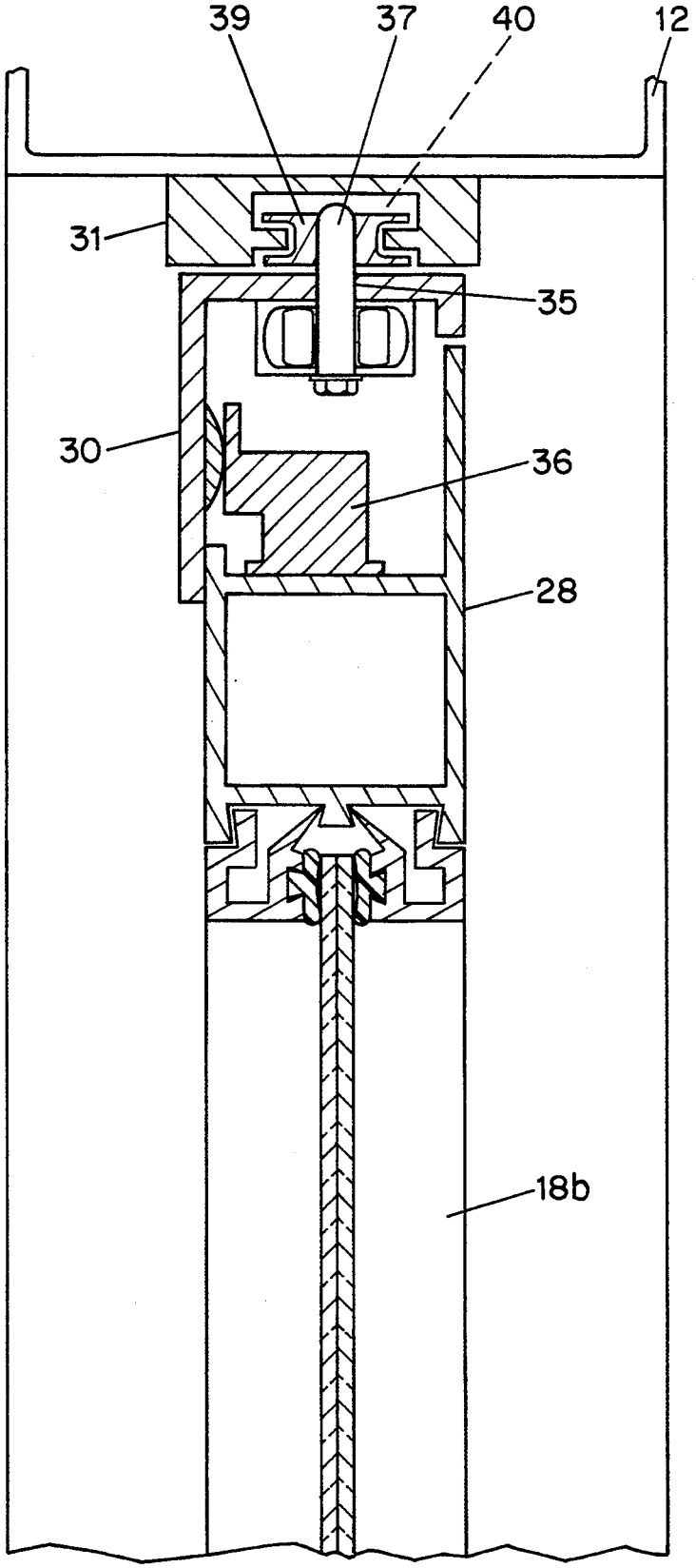
FIG. 5 illustrates a cross-section end view of the attaching mechanism between a bi-folding door panel and the pivoting frame member of the present invention.
Figure 6:
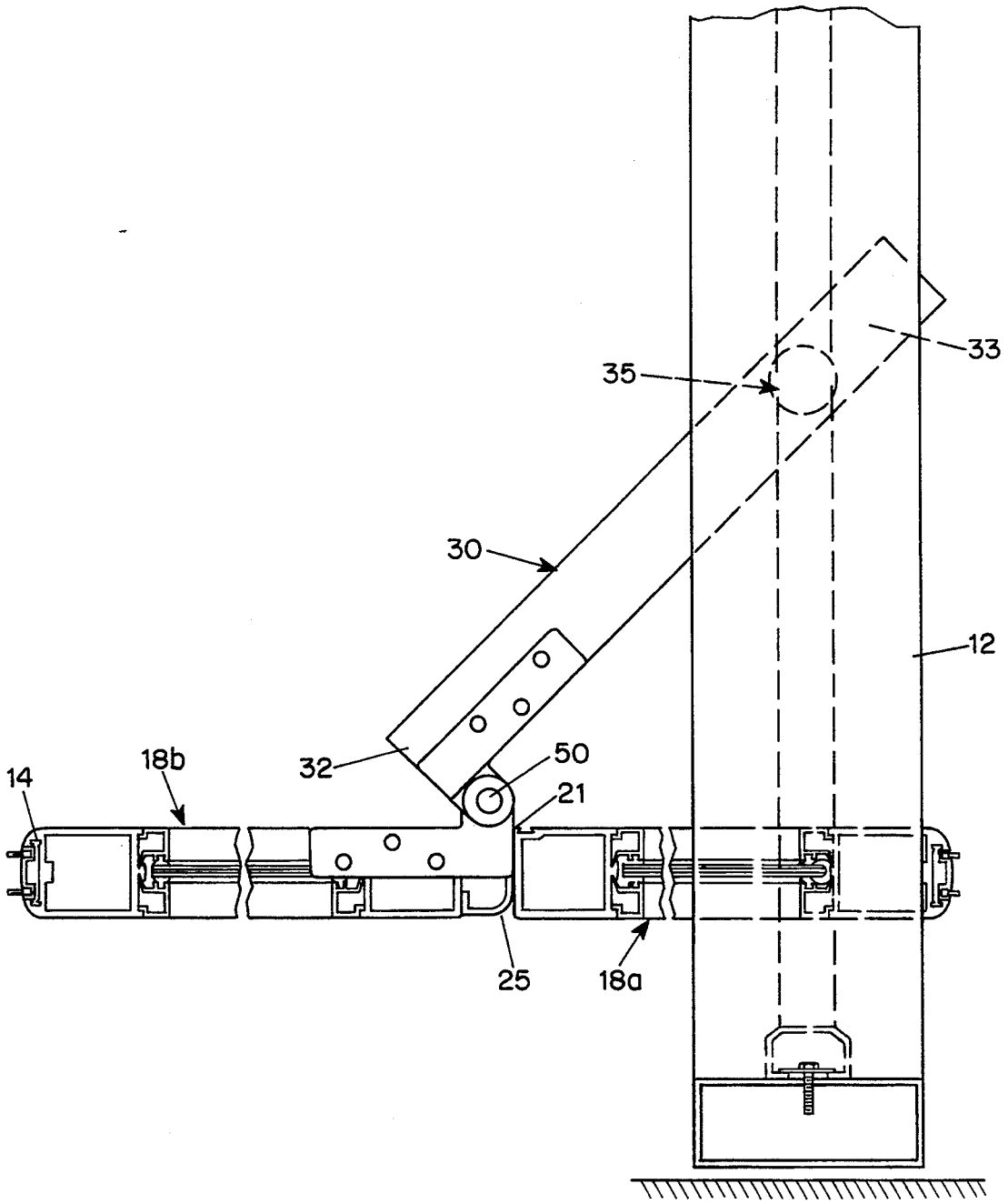
FIG. 6 illustrates a top view of the bi-folding doors in the fully open position in the preferred embodiment of the present invention.

Turning now to the most novel feature of the invention, reference is made to the figures. Unlike first door panel **18*a* , which comprises a continuous door panel from its top portion 27 to its bottom portion 29, door panel 18*b* is modified in this system. There is provided a pivoting frame member 30 extending along the upper end 28 of door panel 18*b*, which would be hinged at its first end 32 to the hinged; edge 21 of door panel 18*b*. This is clearly illustrated in FIG. 6, in top cutaway view. At its second end 33, there would be provided a pin assembly 35, having a pin 37, with a guide roller 39 extending upward from pin 37 which would travel within a slot 40 formed in a continuous guide member 31 secured to the frame 12 of the bi-folding door assembly 10. This is illustrated in FIG. 5. This attachment between the second end 33 of pivoting frame member 30 and the guide member 31 of frame 12 via slot 40 allows pivoting frame member 30 to be secured at both ends 32, 33 with second end 33 able to slide within slot 40** as the doors are opened and closed.

As is further illustrated, there is provided an attachment means between the second end 33 of pivoting frame member 30 and door **18*b* which allows door 18*b* to move together with member pivoting frame 30 when the two are latched together, as is seen in FIGS. 1A through 2B. In the preferred embodiment this attaching means would comprise a magnet 36 formed in the upper portion 28 of door panel 18*b*, that would magnetically attach to a wall 37 of pivoting frame member 30, as clearly illustrated in FIG. 5. The attachment between pivoting frame member 30 and the door panel 18*b* defines the upper edge of the door panel 18*b* when the attachment means has secured pivoting frame member 30 to door panel 18*b*, as seen in FIG. 1A. For purposes of the scope of the invention, although a magnet is cited as the attachment means, any attachment means would be equivalent which allowed disengagement between the pivoting frame member 30 and the door panel 18*b*** upon a certain force.

Figure 3A:
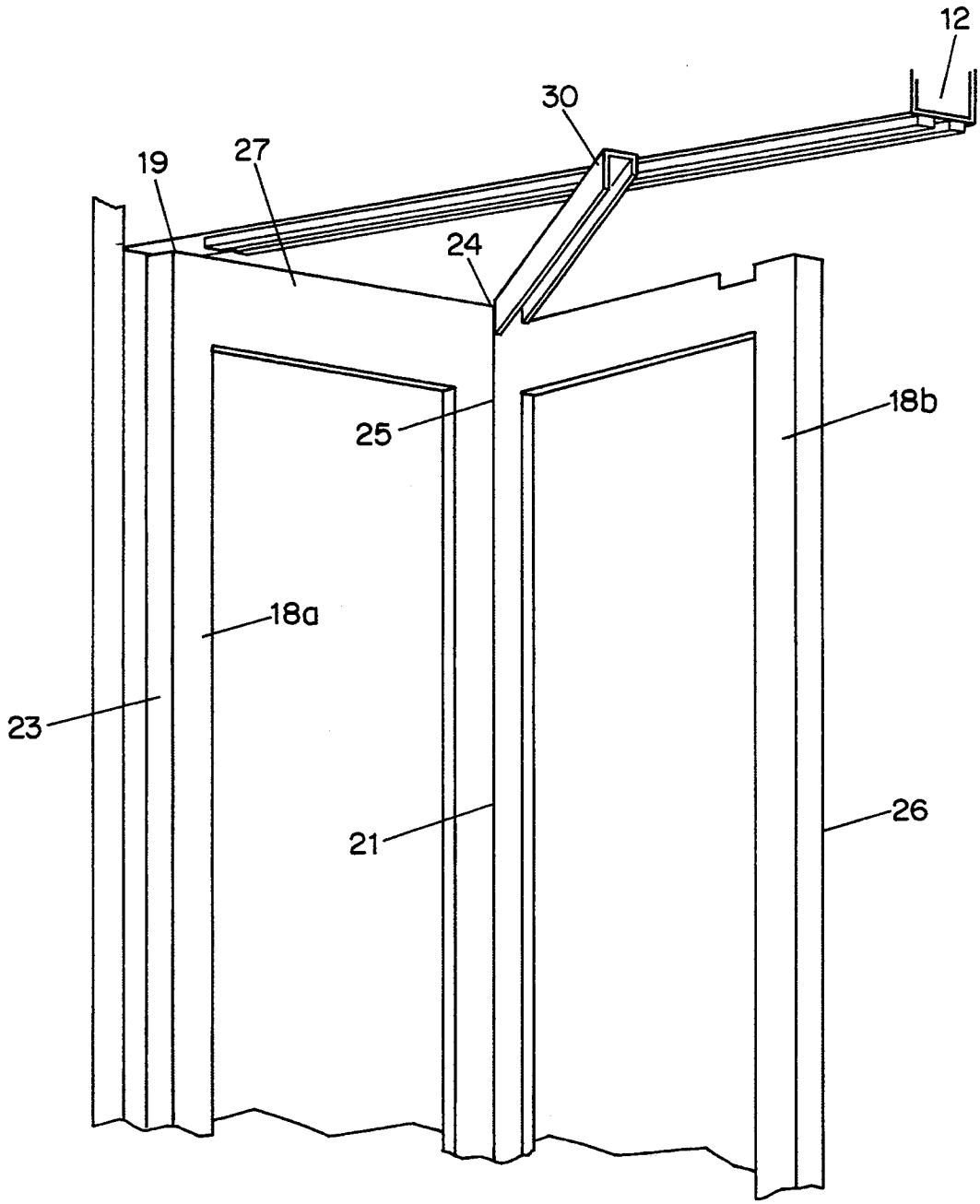
FIGS. 3A and 3B illustrate views of one set of doors of the bi-folding assembly of the preferred embodiment of the present invention in the break-away partially open position and break-away fully open position, respectively.
Figure 3B:
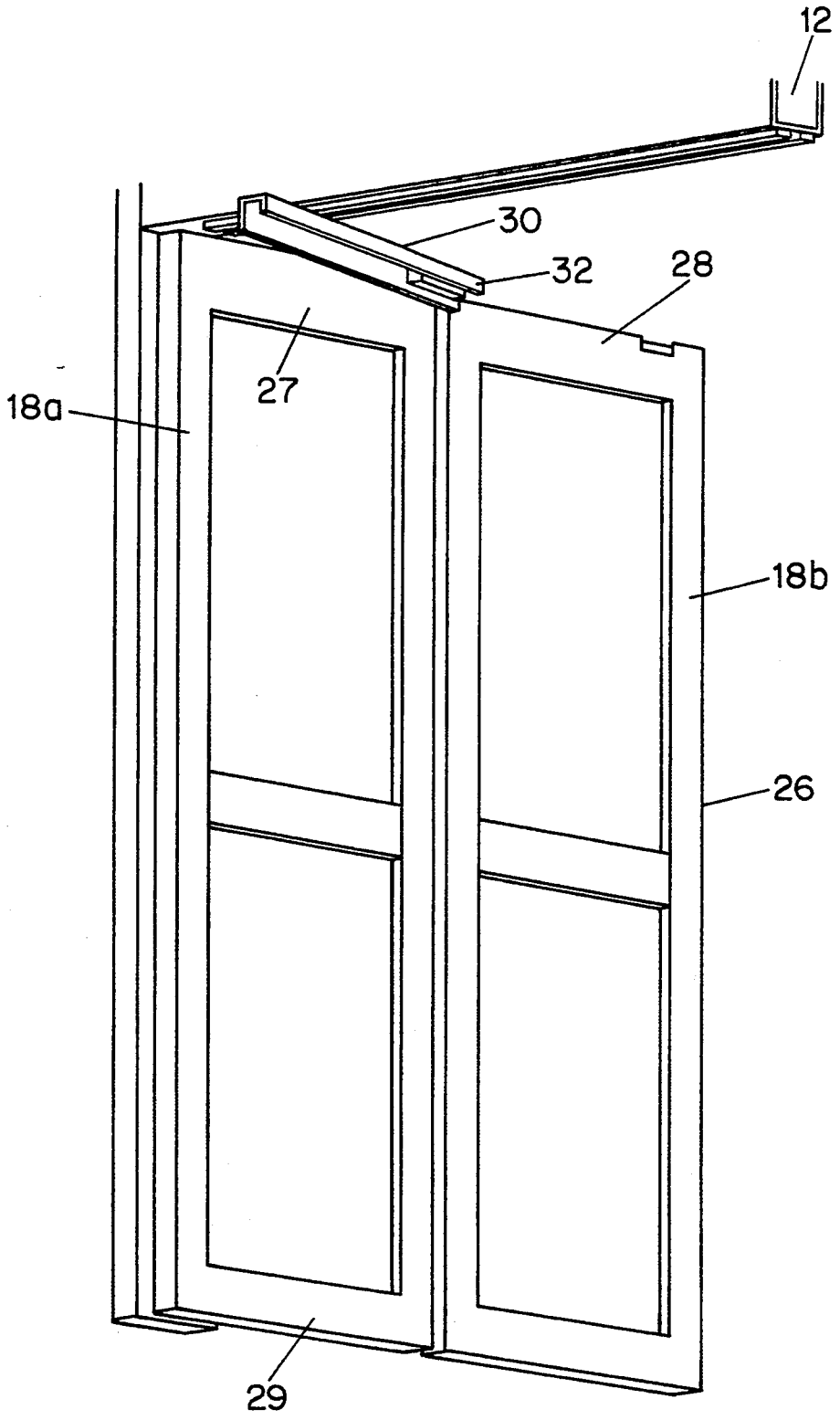
Figure 4A:
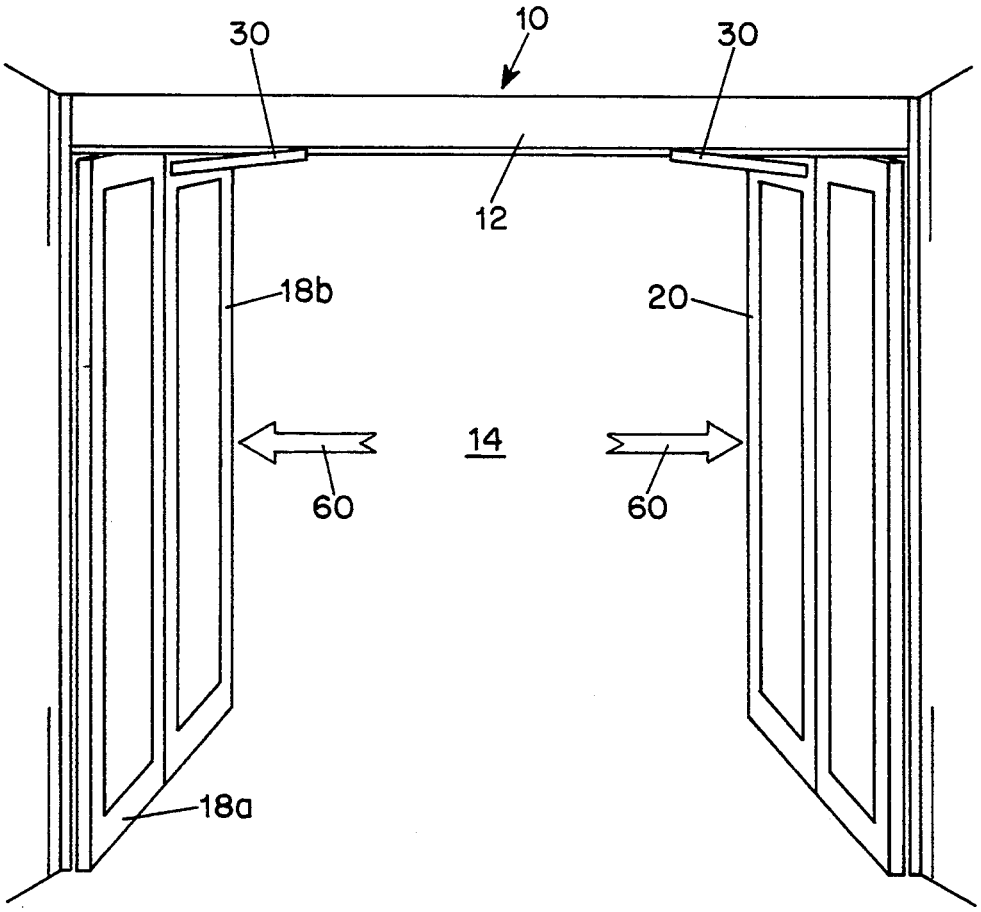
FIGS. 4A and 4B illustrate front and top views of the break away bi-folding door assembly in the preferred embodiment of the present invention in the break-away position.

In this configuration, since the magnet provides that the pivoting frame member 30 be secured against door panel **18*b*, and allows the pivoting frame member 30 to function as part of the door panel 18*b*, door panel 18*a* and 18*b* would open and close as would any set of bi-folding doors. Should one wish to allow the bi-folding door panels 18*a*, 18*b* to open fully, in order to allow a wider opening through the doorway, one would simply place sufficient force against a second outer edge 26 of door panel 18*b*, sufficient to overcome the attachment means, or magnet 36, and door panel 18*b* would be released from the pivoting frame member 30 at its second end 33 and would therefore swing open freely along hinged edge 21, as illustrated in FIG. 3A to the full open position as seen in FIG. 3B. FIGS. 4A likewise illustrates the doors fully opened as depicted by arrows 60, while FIG. 4B illustrates door panel 18*a*, 18*b* partially opened, and door pair 20 fully opened, as seen by the arrows 60**.

Figure 7A:
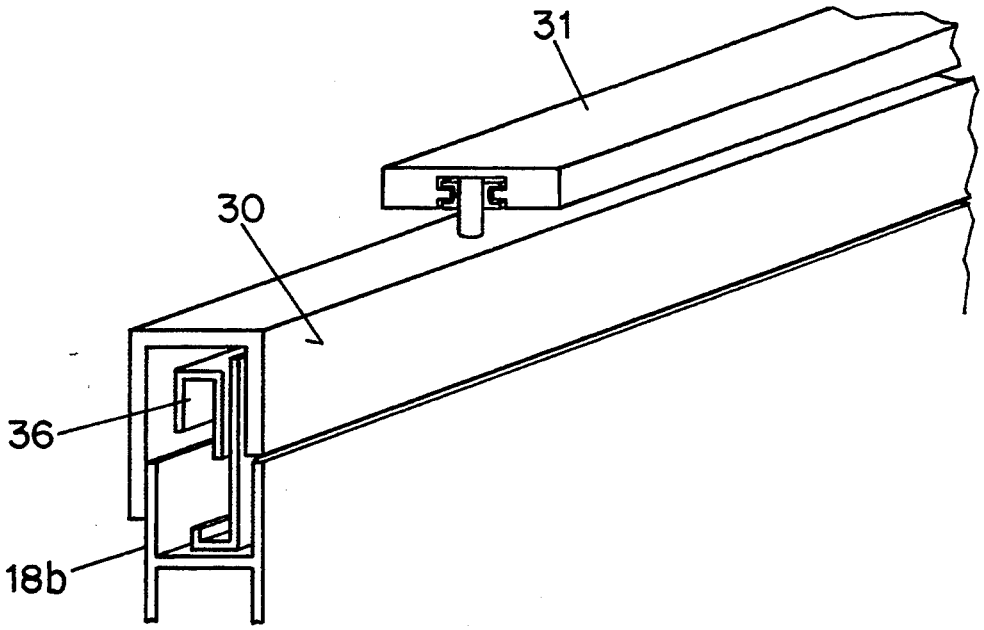
FIGS. 7A and 7B illustrate partial perspective views of the pivoting frame member in relation to a bi-folding door in the present invention.
Figure 7B:
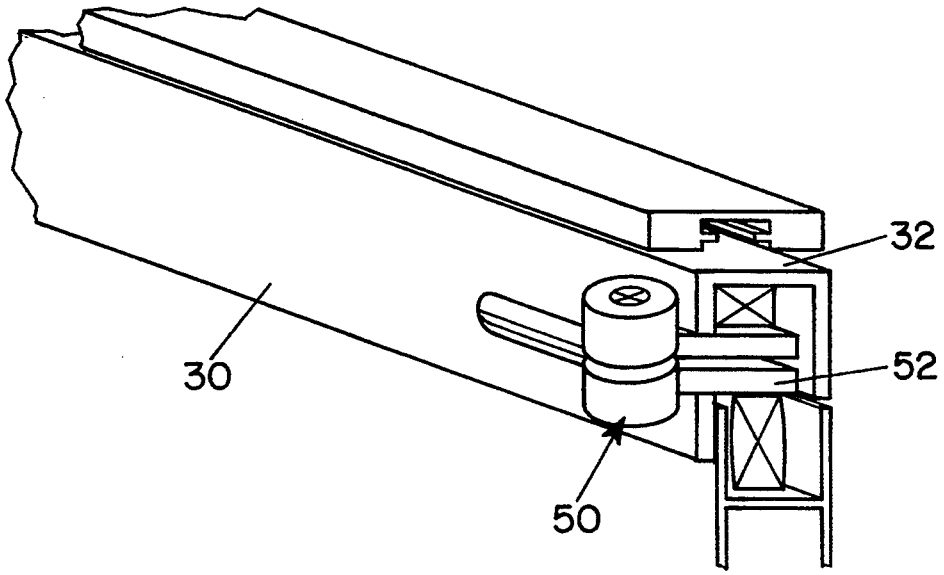

As illustrated in FIG. 7B, the first end 32 of pivoting frame member 30 includes a pivot assembly 50, which mounts pivoting frame member 30 to the hinge connection 52 between door panels **18*a* and 18*b*, so that pivoting frame member 30 may pivot from the upper portion 28 of door panel 18*b* as illustrated in FIG. 3B. Thereafter, when door panel 18*a* moves to its open position, as a bi-folding door, door panel 18*b*, freely swinging, would, rather than fold open, as normal, would freely swing open along edge 21, as illustrated in FIG. 3B**.

Figure 4B:
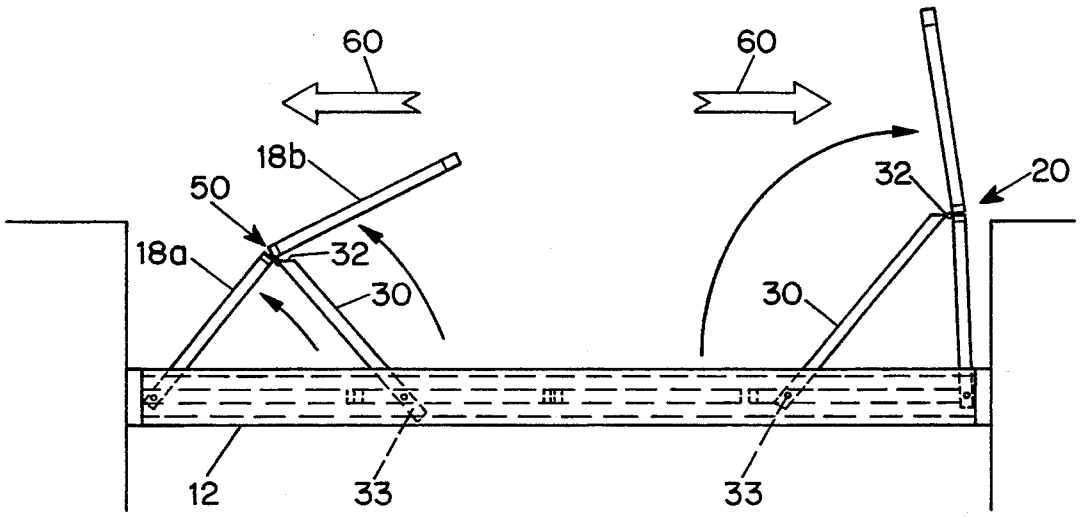

As is noted in the Figures, although the second edge 26 of bi-folding door **18*b* is freely swinging, the pivoting frame member 30 continues to be hingedly attached at its second end 32 to the pivot assembly 50, as seen in FIG. 4B. Therefore, although the door panel 18*b* is freely swinging, when the bi-folding door panels 18*a*, 18*b* are returned to their normal bi-folding configuration, the doors can simply be closed, and when this is done, the pivoting frame member 30 slides along slot 40, and as door panel 18***b* moves to the closed position, the latching means, preferably magnet 36 is in position to reengage door panel 18*b* automatically and to return to function as a normal, bi-folding door, as is illustrated in FIGS. 1A through 2B.

Parts List:

Breakaway bi-folding door apparatus 10
upper frame 12
doorway 14
two door pairs 18, 20
pair of door panels 18*a*, 18*b*
hinge 19
common edges 21
first hinged edge 23 of door panel 18*a*
second edge 24 of door panel 18*a*
first edge 25 of door panel 18*b*
second edge 26 of door panel 18*b*;
top portion 27 of door panel 18*a*
bottom portion 29 of door panel 18*a*
upper portion 28 of door panel 18*b*
pivoting frame member 30
guide member 31
first end 32 of pivoting frame member 30
second end 33 of pivoting frame member 30
pin assembly 35
pin 37
guide roller 39
slot 40
magnet 36
pivot assembly 50
arrows 60

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

I claim:

1. A breakaway bi-folding door assembly, comprising:

a) at least one set of two bi-folding door panels, of the type having a first edge of a first door panel hinged to a frame, and a second edge of a second door panel having a guide travelling within a slot in the frame to allow the door panels to fold and unfold between open and closed positions;

b) a pivoting frame member, positioned along the upper portion of said second door panel, having one end hingedly engaged to said second panel; and c) means for releasably attaching said pivoting frame member to said second door panel, so that when the frame member is attached to said second door panel, it travels with the door panel, said attaching means being disengageable by force thereon, whereby said second door panel is allowed to swing freely to a full open position.

2. The assembly in claim 1, further comprising a second bi-folding door assembly to define a pair of bi-folding doors in a passageway.

3. The assembly in claim 1, wherein said pivoting frame member further comprises a second end comprising said guide, so that the second end travels along the frame during opening and closing of said door.

4. The assembly in claim 1, wherein the means for releasably attaching said pivoting frame member further comprises a magnet.

5. The assembly in claim 1, wherein said pivoting frame member may be disengaged from said second door panel through a manual force to a second end of said second door panel.

6. The assembly in claim 1, wherein said pivoting frame member and said releasable attaching means are arranged to allow disengagement at any position of the bi-folding door.

7. In a bi-folding door assembly, having a first door panel hingedly attached at a first edge to a door frame and hingedly attached at a second edge to a first edge of a second door panel and wherein a second edge of said second door panel is arranged to travel along a guide member to allow said door to open and close in a folding operation, the improvement wherein said second door panel is connected to said guide member by a pivoting frame member, and said pivoting frame member is pivotably connected to said second door panel at said first edge thereof and is releasably attached to said second edge of said second door panel, whereby said second door panel can freely pivot with respect to said first door panel upon release from said pivoting frame member.

8. A break-away bi-folding door assembly, comprising:

a first door panel hinged to a door frame at a first edge and hinged to a first edge of a second door panel at a second edge;

said second door panel having a pivoting frame member releasably attached to the upper portion thereof, said pivoting frame member being hingedly connected to said second door panel at a first end of said pivoting frame member and in the region of said first edge of said second door panel, and said releasable attachment being arranged to maintain a second edge of said second door panel in allignment with a second end of said pivoting frame member; and a guide member on said pivoting frame member near said second end for engaging and traveling in a guide slot on a door frame;

whereby when said pivoting frame member is attached to said upper portion of said second door panel, said second door panel moves with said pivoting frame member to fold against said first door panel, and when said pivoting frame member is released from said second door panel, said second door panel can swing with said first door panel about said hinged connection to said frame.

* * * * *

UNITED STATES PATENT AND TRADEMARK OFFICE

CERTIFICATE OF CORRECTION

PATENT NO. : 5,392,834

DATED : February 28, 1995

INVENTOR(S) : Ronald Borgardt

It is certified that error appears in the above-identified patent and that said Letters Patent is hereby corrected as shown below:

Cover Page, 5th line of ABSTRACT, "panel" should read --panels--;
Cover Page, 3rd-from-bottom line of ABSTRACT, "slot, the second door" should read --slot to the closed door position, the second door panel--;
Cover Page, 2nd-from-bottom line of ABSTRACT, "would return" should read --returns--;
Col. 2, line 24, "first second" should read --second--;
line 35, "plate member" should read --pivoting frame member--;
Col. 4, line 1, "hinged; edge" should read --hinged common edge;
line 17, "member pivoting frame" should read --pivoting frame member--;
line 36, "door panel 18a" should read --door panels 18a--;
line 63, "door 18b" should read --door panel 18b--;
Col. 6, lne 47, "allignment" should read --alignment--.

Signed and Sealed this

Fourth Day of July, 1995

Bruce Lehman

*Attest:*

BRUCE LEHMAN

*Attesting Officer*

*Commissioner of Patents and Trademarks*